United States Patent [19]

Tamura et al.

[11] Patent Number: 4,836,252

[45] Date of Patent: Jun. 6, 1989

[54] WARP YARN BREAKAGE DETECTING AND INDICATING APPARATUS

[75] Inventors: Zenji Tamura; Katsuhiko Sugita, both of Kanazawa, Japan

[73] Assignee: Tsudakoma Kogyo Kabushiki Kaisha, Kanazawa, Japan

[21] Appl. No.: 196,607

[22] Filed: May 20, 1988

[30] Foreign Application Priority Data

May 26, 1987 [JP] Japan ..... 62-79594[U]
Jan. 1, 1988 [JP] Japan ..... 63-68

[51] Int. Cl.[4] ..... D03D 51/30
[52] U.S. Cl. ..... 139/353
[58] Field of Search ..... 139/336, 349, 353, 358, 139/369; 66/163

[56] References Cited

U.S. PATENT DOCUMENTS 3,324,899 6/1967 Stagg ..... 139/353

FOREIGN PATENT DOCUMENTS 48604 4/1986 Japan ..... 139/353
48210 10/1982 U.S.S.R. ..... 139/353
626 1/1988 World Int. Prop. O. ..... 139/353

*Primary Examiner*—Henry S. Jaudon
*Attorney, Agent, or Firm*—Oblon, Spivak, McClelland, Maier & Neustadt

[57] ABSTRACT

A warp yarn breakage detecting and indicating apparatus capable of stopping the loom upon the detection of the breakage of a warp yarn and indicating the position of the broken warp yarn. The warp yarn breakage detecting and indicating apparatus comprises a stop control circuit for stopping the loom upon the detection of the breakage of a warp yarn, and an indication control circuit for indicating the position of the broken warp yarn, which are connected alternately to the dropper unit of the loom. Thus, the two control circuits are able to operate individually to implement the respective control functions thereof without adversely affecting each other for warp yarn breakage detection and for warp yarn breakage indication.

7 Claims, 4 Drawing Sheets

WARP YARN BREAKAGE DETECTING AND INDICATING APPARATUS

BACKGROUND OF THE INVENTION

The present invention relates to a warp yarn breakage detecting and indicating apparatus which provides a stop signal upon the detection of warp yarn breakage on a loom and indicates the exact position of warp yarn breakage.

The warp yarn breakage detecting apparatus of a dropper system has well been known in the textile industry. The known warp yarn breakage detecting apparatus comprises a plurality of droppers hung on warp yarns, respectively, of a warp, and a dropper bar disposed under the warp so that the droppers will fall thereon when the associated warp yarns are broken, and detects the drop of a dropper thereon electrically to provide a stop signal for stopping the loom.

It has been found that the reliability of the warp yarn breakage detecting apparatus of a dropper system is enhanced through the improvement of the contact between the dropper and the dropper bar, and a technique has been proposed to apply a voltage of more than 50 V to the dropper bar.

On the other hand, a warp yarn breakage indicating apparatus has been developed to enable efficient work for searching and repairing a broken warp yarn after the loom has been stopped, by indicating the position of the broken warp yarn. This warp yarn breakage indicating apparatus employs a dropper bar formed of a longitudinally continuous electrically resistive member and specifies the position of the dropper which has dropped on the dropper bar, by measuring the electric resistance of a portion of the electrically resistive member between one end of the same and a position where the dropped dropper came into contact with the electrically resistive member.

The respective requisite characteristics of the warp yarn breakage detecting apparatus and the warp yarn breakage indicating apparatus will be described comparatively hereinafter.

The warp yarn breakage detecting apparatus is desired to be able to function at a high operating speed which will not cause the malfunction of the warp yarn breakage detecting apparatus due to the vibration of the loom to limit the defect formed on the fabric by warp yarn breakage to the least possible extent so that the defect can simply be repaired.

On the other hand, the warp breakage indicating apparatus is desired to be able to provide a sufficiently stable measurement signal for highly reliable detection of the position of the broken warp yarn and for the indication of the position of the broken warp yarn. Accordingly, the measurement signal must be processed by a measurement signal processing circuit having a sufficiently large time constant in a state where the mechanical vibration of the dropper does not occur. Such an operation is unable to be achieved at a high speed.

Thus, the warp yarn breakage detecting apparatus and the warp yarn breakage indicating apparatus are contrary to each other in the operating speed. Furthermore, it is preferable to apply a high voltage to the dropper unit of the warp yarn breakage detecting apparatus to ensure the reliable operation of the warp yarn breakage detecting apparatus, whereas it is preferable that the warp yarn breakage indicating apparatus operates on the lowest necessary voltage to avoid the useless heat generation of the electrically resistive member.

Accordingly, two types of dropper units, which require troublesome work for operation, need to be provided unavoidably entailing a serious problem that the constitution of the loom becomes complex when the warp yarn breakage detecting apparatus and the warp yarn breakage indicating apparatus are provided individually on the loom.

SUMMARY OF THE INVENTION

Accordingly, it is an object of the present invention to provide a novel warp yarn breakage detecting and indicating apparatus having a single dropper unit and capable of meeting the respective requisite characteristics of the warp yarn breakage detecting apparatus and the warp yarn breakage indicating apparatus without making the general constitution of the loom complex.

It is another object of the present invention to prevent the component elements of a circuit associated with a common dropper unit for both warp yarn breakage detection and warp yarn breakage indication from being damaged by electric charge accumulated in the dropper bar of the dropper unit.

Figure 1:
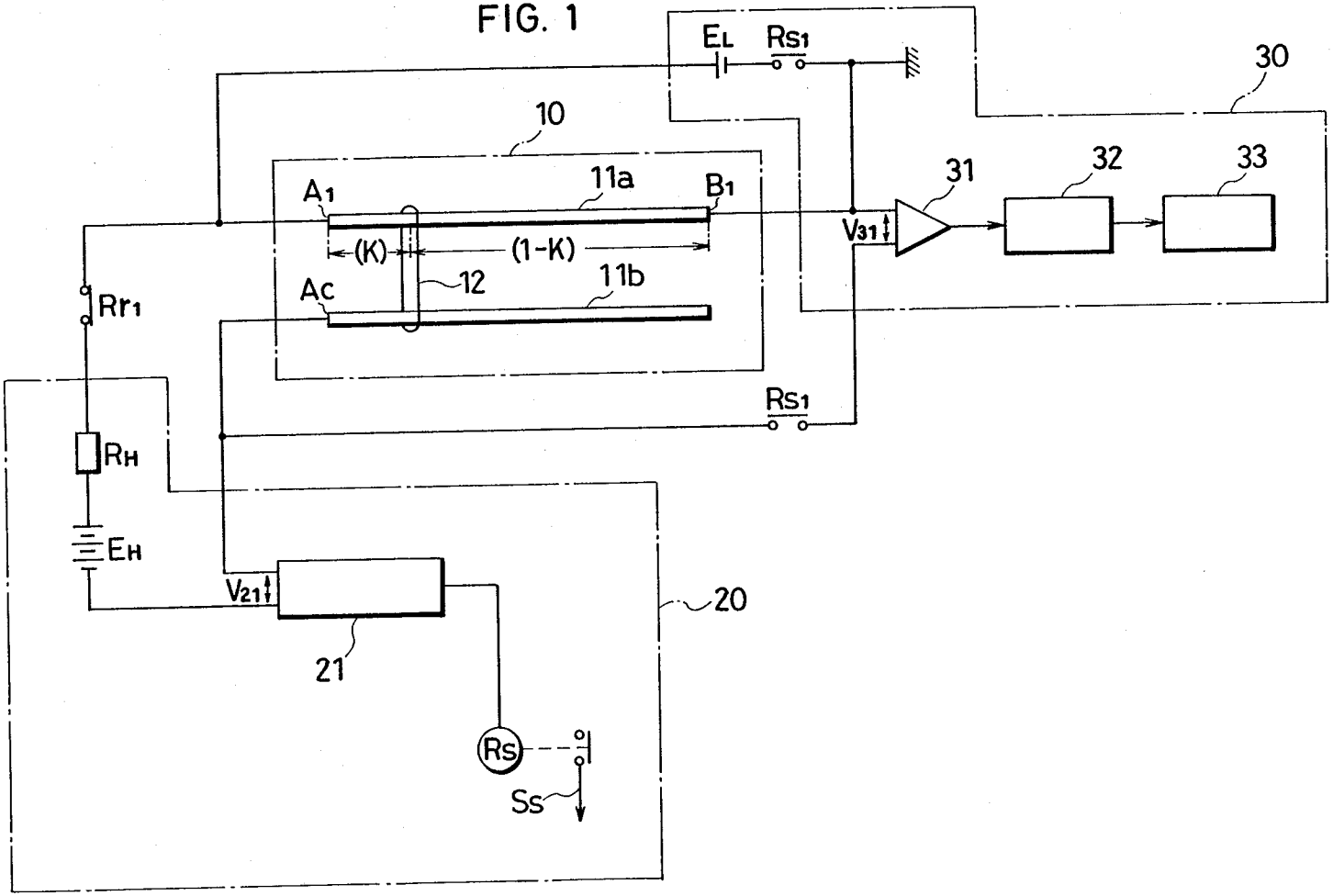
FIG. 1 is a circuit diagram of assistance in explaining the general constitution of a warp yarn breakage detecting and indicating apparatus, in a first embodiment, according to the present invention.

List of Reference Characters:

Ss . . . Stop signal
W . . . Warp yarn
$E_H$ . . . First DC power supply
$E_L$ . . . Second DC power supply
$V_H$, $V_L$ . . . Output voltages
$V_{21}$ . . . Actuating signal
$V_{31}$ . . . Position signal
$R_L$ . . . Current limiting resistance

DETAILED DESCRIPTION OF THE PREFERRED EMBODIMENTS

A warp yarn breakage detecting and indicating apparatus, in a first embodiment, according to the present invention will be described with reference to FIGS. 1 and 2.

The warp yarn breakage detecting and indicating apparatus for a loom comprises a dropper unit 10, a stop control circuit 20 and an indication control circuit 30.

The dropper unit 10 comprises a dropper bar 11 having, in combination, a resistive bar 11*a* and a conductive bar 11*b*, and droppers 12.

Figure 2:
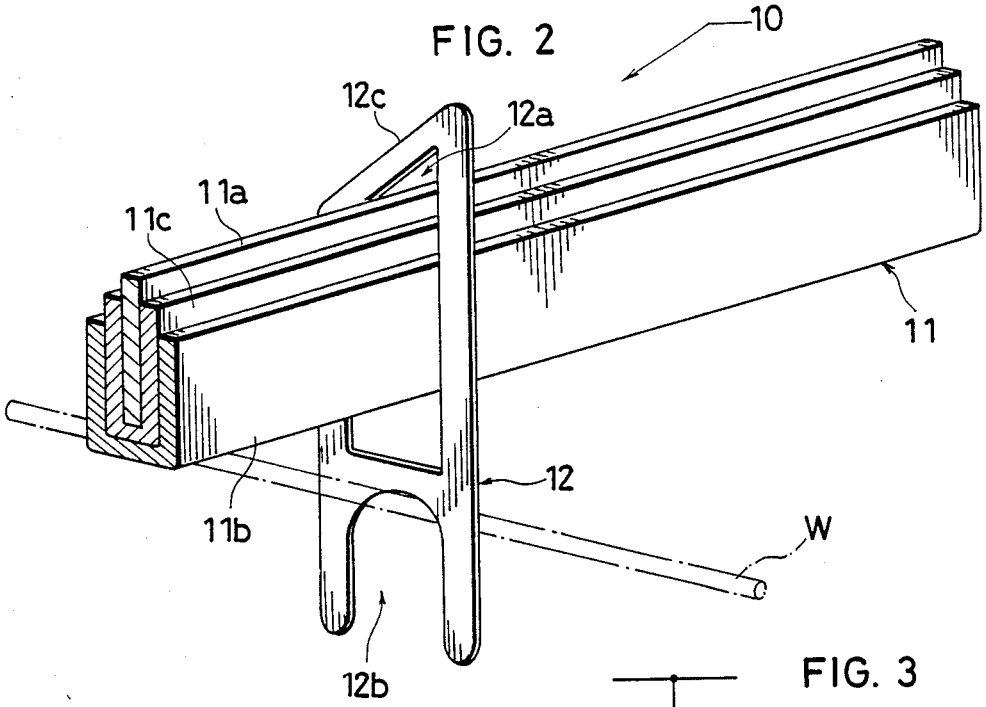
FIG. 2 is a perspective view of assistance in explaining an essential portion of a dropper unit incorporated into the warp yarn breakage detecting and indicating apparatus of FIG. 1.

As shown in FIG. 2, the dropper bar 11 is an elongate member formed by fitting the resistive bar 11*a* through an insulating bar 11*c* in the conductive bar 11*b* having a U-shaped cross section. The resistive bar 11*a* is an electrically resistive plate having a uniform shape extending along the longitudinal direction of the dropper bar 11 or an electrically resistive unit formed by uniformly winding a resistive wire around an insulating plate. The dropper bar 11 has a length sufficient to extend over the entire width of the plurality of warp yarns W of a warp, not shown. In FIG. 2, only one warp yarn W and only one dropper 12 are shown.

The dropper 12 is an elongate, thin metallic plate having a through hole 12*a* for receiving the dropper bar 11 therethrough and a recess 12*b* engaging the warp W. The upper end of the through hole 12*a* is defined by an inclined portion 12*c*. The droppers 12 are provided each for one warp yarn W. While the warp yarn W is in a normal state, the dropper 12 is held at an upper position by the associated warp yarn W. When the warp yarn W is broken, the dropper 12 is caused to drop by its dead weight onto the dropper bar 11 to electrically short-circuit the resistive bar 11*a* and the conductive bar 11*b*. Accordingly, the shapes of the through hole 12*a* and recess 12*b* of the dropper 12 may be such other than the shapes shown in FIG. 2 provided that the dropper 12 is able to achieve the foregoing function. The inclined portion 12*c* defining the upper end of the through hole 12*b* of the dropper 12 shown in FIG. 2 ensures the stable mechanical and electrical contact of the dropper 12 with both the resistive bar 11*a* and the conductive bar 11*b*.

The stop control circuit 20 includes a first DC power supply $E_H$ and a voltage detecting circuit 21 (FIG. 1). Preferably, the first DC power supply $E_H$ is a high-voltage power supply having an output voltage capacity of 50 V or above. One of the terminals of the first DC power supply $E_H$ is connected through a resistor $R_H$ having a high resistance and a relay contact $Rr_1$ to one end $A_1$ of the resistive bar 11*a* of the dropper unit 10. The other terminal of the first DC power supply $E_H$ is connected to an input terminal of the voltage detecting circuit 21. One end Ac of the conductive bar 11*b* corresponding to the end $A_1$ of the resistive bar 11*a* is connected to an input terminal of the voltage detecting circuit 21. The output terminal of the voltage detecting circuit 21 is connected to a relay Rs to give a stop signal Ss through the relay Rs to an external device. The relay contact $Rr_1$ is included in a loom control circuit, not shown. The relay contact $Rr_1$ is closed while the loom is operating and is opened while the loom is stopped. The voltage detecting circuit 21 includes, as occasion demands, a voltage amplifier, an integrator having a small time constant, a relay driver and other necessary devices. When an actuating signal $V_{21}$ of a level above a fixed level is applied to the input terminal of the voltage detecting circuit 21, the voltage detecting circuit 21 is able to operate the relay Rs.

the voltage detecting circuit 21 is able to operate the relay Rs.

The indication control circuit 30 comprises an arrangement of an amplifier 31 an AD converter 32 and an indicator 33 connected in series in that order, and a second DC power supply $E_L$. One of the input terminals of the amplifier 31 is grounded and is connected to the other end $B_1$ of the resistance bar 11*a* opposite the end $A_1$ connected to the first DC power supply $E_H$. One of the terminals of the second DC power supply $E_L$ is connected through a relay contact $Rs_1$ to the end $B_1$ of the resistive bar 11*a* while the other terminal of the same is connected to the end $A_1$ of the resistive bar 11*a*. The end Ac of the conductive bar 11*b* connected to the voltage detecting circuit 21 is connected through the relay contact $Rs_1$ to the other input terminal of the amplifier 31. The relay contacts $Rs_1$ are normally open contacts of the relay Rs included in the stop control circuit 20.

The operation of the warp yarn breakage detecting and indicating apparatus thus constituted will be described hereinafter.

When the loom is in operation and all the warp yarns W are in the normal state, the relay contact $Rr_1$ is closed and the relay Rs of the stop control circuit 20 is in a reset state. Consequently, the output voltage $V_H$ of the first DC power supply $E_H$ is applied to the end $A_1$ of the resistive bar 11*a* of the dropper unit 10. However, since all the droppers 12 are supported by the associated warp yarns W respectively at the upper positions, i.e., the normal positions, and hence the resistive bar 11*a* and the conductive bar 11*b* of the dropper bar 11 are not short-circuited, no current flows through the conductive bar 11*b* and hence the voltage detecting circuit 21 remains inoperative.

When any one of the warp yarn W is broken, the dropper 12 which has been supported by the warp yarn W drops onto the dropper bar 11 to short-circuit the resistive bar 11*a* and the conductive bar 11*b*. When the output voltage $V_H$ of the first DC power supply $E_H$ is high enough to break insulating metal oxide films coating the respective surfaces of the resistive bar 11*a*, the conductive bar 11*b* and the dropper 12, the resistive bar 11*a* and the conductive bar 11*b* can satisfactorily be connected electrically by the dropper 12.

When the resistive bar 11*a* and the conductive bar 11*b* are thus short-circuited, an actuating signal $V_{21}$ corresponding to the output voltage $V_H$ of the first DC power supply $E_H$ appeared on the conductive bar 11*b* is applied to the voltage detecting circuit 21, and thereby the relay Rs is operated. Then, a stop signal Ss is given to the loom control circuit, not shown, to stop the loom automatically and immediately.

Suppose that the position of the dropper 12 dropped due to the breakage of the associated warp yarn W on the dropper bar 11 is a position dividing the entire length of the resistive bar 11*a* in a ratio of $(K):(1-K)$, where $0 \leqq K \leqq 1$. In this case, when the resistance of the resistor $R_H$ is sufficiently greater than the resistance $R_0$ of the entire length of the resistive bar 11*a*, the actuating signal $V_{21}$ is fixed irrespective of the value of K. Accordingly, the sensitivity of the stop control circuit 20 is not dependent on the value of K, and the response speed of the stop control circuit 20 can optionally be decided by selectively deciding the operating speed of the voltage detecting circuit 21.

When the relay Rs is actuated to provide the stop signal Ss, the loom is stopped and thereby the relay contact $Rr_1$ is opened and the relay contacts $Rs_1$ are closed. Consequently, the first DC power supply $E_H$ is disconnected from the resistive bar 11*a*, and the second DC power supply $E_L$ of the indication control circuit 30 is connected to the opposite ends $A_1$ and $B_1$ of the resistive bar 11*a*.

A position signal $V_{31}$ applied to the amplifier 31 of the indication control circuit 30 in this state is expressed by $$V_{31}=V_L(1-K)$$

where $V_L$ is the output voltage of the second DC power supply $E_L$. That is the position signal $V_{31}$ is a voltage corresponding to a division of the output voltage $V_L$ of the second DC power supply $E_L$ according to the position of the dropped dropper 12 on the resistive bar 11*a*. The position signal $V_{31}$ is converted into a digital signal by the AD converter 32, and then a value corresponding to the output digital signal of the AD converter 32 is displayed numerically on the indicator 33 to indicate the exact position of the dropped dropper 12 on the dropper bar 11, namely, the exact position of the broken warp yarn W. It is possible to indicate the position of the broken warp yarn W on the indicator 33 in a value corresponding to the distance of the position of the dropped dropper 12 on the dropper bar 11 from a reference position on the dropper bar 11 through appropriate unit permutation.

It is desirable to indicate a value representing the accurate position of the dropped dropper 12, which is determined after the mechanical vibrations of the dropped dropper 12 have completely fallen, on the indicator 33. Furthermore, since the indication on the indicator 33 need not necessarily be read immediately after the loom has been stopped, it is preferable that the amplifier 31 has a time constant large enough to meet necessary and sufficient conditions, and an amplifier having a low response speed serves satisfactorily. It is preferable to supply a small current to the resistive bar 11*a* to suppress the heat generation of the resistive bar 11*a*, and hence the output voltage $V_L$ of the second DC power supply $E_L$ may be a low voltage. However, when the resistance of the resistive bar 11*a* is sufficiently large to suppress the heat generation of the resistive bar 11*a*, the output voltage $V_L$ of the second DC power supply $E_L$ need not particularly be low, and hence the respective output voltages $V_H$ and $V_L$ of the first DC power supply $E_H$ and the second DC power supply $E_L$ may be the same.

The relay contact $Rs_1$ connected in series to the second DC power supply $E_L$ among the relay contacts $Rs_1$ for connecting the indication control circuit 30 to and for disconnecting the same from the dropper unit 10 is provided to avoid useless heat generation of the resistive bar 11*a* by disconnecting the second DC power supply $E_L$ to the opposite ends of the resistive bar 11*a* only when the operation of the indication control circuit 30 is unnecessary. Therefore, the relay contact $Rs_1$ may be omitted when the heat generated by the resistive bar 11*a* when the output voltage $V_L$ of the second power supply $E_L$ is applied thereto is negligible.

A warp yarn breakage detecting and indicating apparatus, in a second embodiment, according to the present invention will be described hereinafter with reference to FIGS. 3 and 4.

The warp yarn breakage detecting and indicating apparatus in the second embodiment is similar to the first embodiment in constitution and hence only the difference of the second embodiment from the first embodiment will be described.

Figure 3:
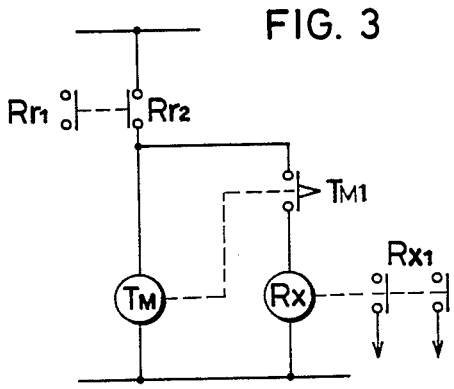
FIG. 3 is a circuit diagram of assistance in explaining an essential portion of a warp yarn breakage detecting and indicating apparatus, in a second embodiment, according to the present invention.
Figure 4:
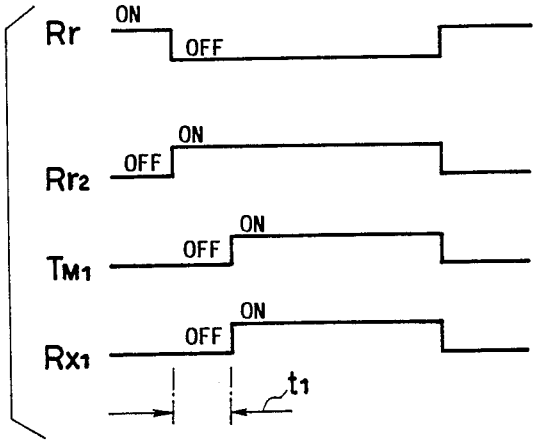
FIG. 4 is a time chart showing signals used in the warp yarn breakage detecting and indicating apparatus of FIG. 3.

The warp yarn breakage detecting and indicating apparatus in the second embodiment has an additional circuit as shown in FIG. 3 including a normally closed contact $Rr_2$ interlocked with the relay contact $Rr_1$, a timer $T_M$ connected in series to the contact $Rr_2$ and having an ON-delay contact $T_{M1}$, and an auxiliary relay Rx connected to the ON-delay contact $T_{M1}$ and having relay contacts $Rx_1$, which substitute the relay contacts $RS_1$ of FIG. 1. The relay contact $Rr_1$ opens when the dropper 12 drops during the operation of the loom, and thereby the contact $Rr_2$ is closed to start the timer $T_M$. Then, the ON-delay contact $T_{M1}$ is closed a set time $t_1$ for which the timer $T_M$ is set after the timer $T_M$ has been started (FIG. 4). Thus, the connection of an indication control circuit 30 to the dropper unit 10 can be delayed by the set time $t_1$ after the disconnection of a stop control circuit 20 from the dropper unit 10 by opening the relay contact $Rr_1$.

Since the dropper bar 11 is a combination of the resistive bar 11*a* and the conductive bar 11*b* with the insulating bar 11*c* therebetween, the dropper bar 11 is equivalent to a capacitor. Accordingly, the output voltage $V_H$ of a first DC power supply $E_H$ is applied to the dropper bar 11 while the stop control circuit 20 is connected to the dropper unit 10 to charge the dropper bar 11, and the charge persists. In disconnecting the dropper unit 10 from the stop control circuit 20 and connecting the same to the indication control circuit 30 immediately after the loom has been stopped, it is possible that the position signal $V_{31}$ applied to the indication control circuit 30 is an erroneous signal as large as the output voltage $V_H$ of the first DC power supply $E_H$. Particularly, when the output voltage $V_H$ is a high voltage, it is possible that the component elements of the indication control circuit 30 are damaged by the erroneous signal. On the other hand, the charge of the dropper bar 11, in general, is discharged through the dropped dropper 12. Accordingly, no erroneous signal is included in the position signal $V_{31}$ and hence the malfunction of the indication control circuit 30 and the destruction of the component elements of the indication control circuit 30 are obviated when the set time $t_1$ is longer than a time necessary for discharging the charge of the dropper bar 11.

A warp yarn breakage detecting and indicating apparatus, in a third embodiment, according to the present invention will be described hereinafter with reference to FIGS. 5(A) and 5(B). The third embodiment is similar to the foregoing embodiments and hence only those of the third embodiment different from the foregoing embodiments will be described.

Figure 5B:
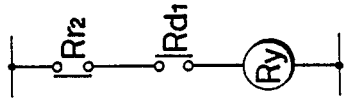
FIG. 5(B) is an illustration of an essential portion of the warp yarn breakage detecting and indicating apparatus of FIG. 5(A)
Figure 5A:
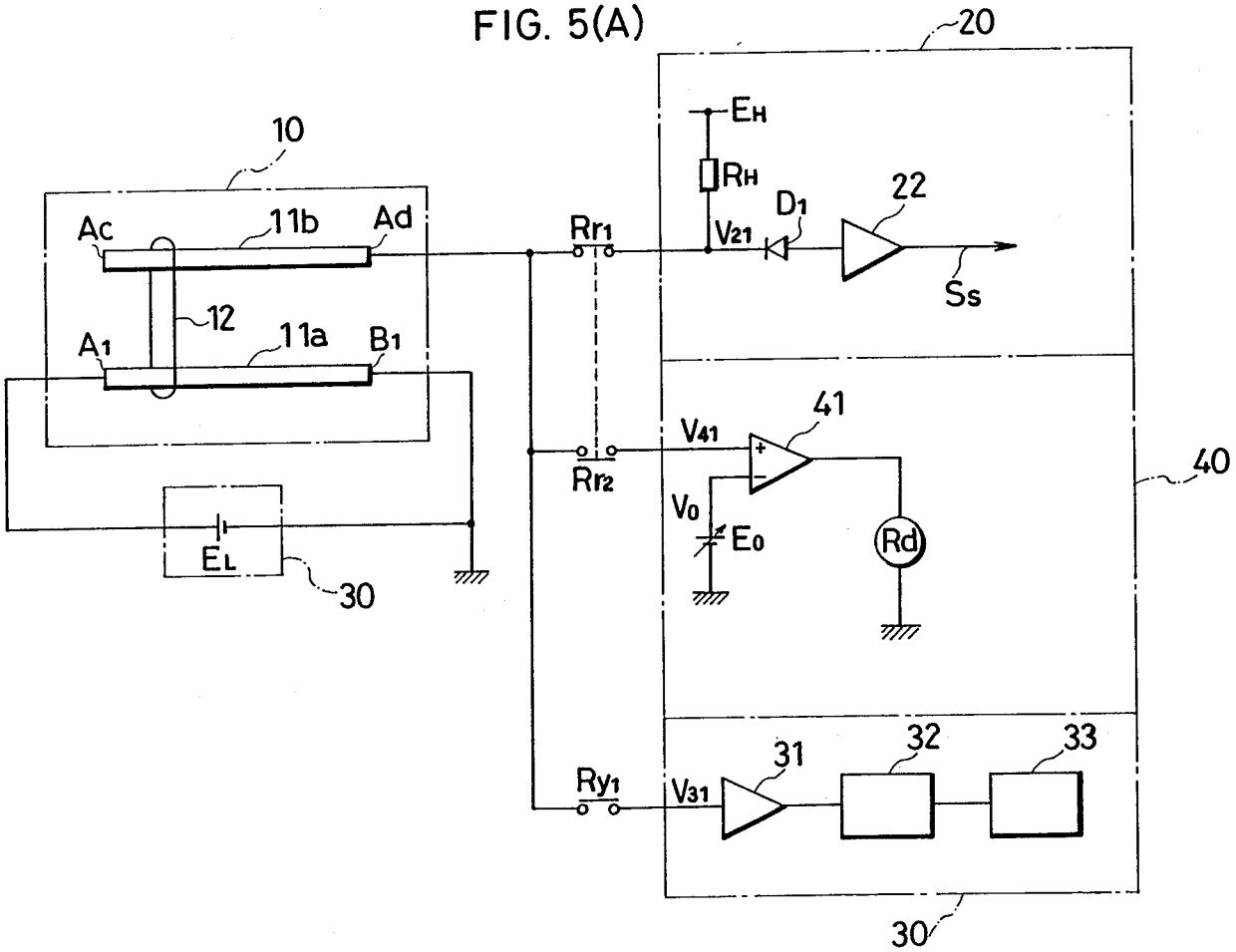
FIG. 5(A) is a circuit diagram of assistance in explaining the general constitution of a warp yarn breakage detecting and indicating apparatus, in a third embodiment, according to the present invention.

The timing of changing over the circuit connected to a dropper unit 10 from a stop control circuit 20 to an indication control circuit 30 can be controlled by a changeover control circuit 40 having a comparator 41 (FIG. 5(A)). The stop control circuit 20 connects a first DC power supply $E_H$ through a resistor $R_H$ having a high resistance and a relay contact $Rr_1$ to one end Ad of the conductive bar 11*b* of the dropper unit 10, applies the voltage at the junction of the resistor $R_H$ and the relay contact $Rr_1$ as an actuating signal $V_{21}$ through a diode $D_1$ to an amplifier 22 to use the output of the amplifier 22 as a stop signal Ss.

The comparator 41 of the changeover control circuit 40 has an addition input terminal connected through a relay contact $Rr_2$ connected to the end Ad of the conductive bar 11*b*, a subtraction input terminal connected to a reference power supply $E_0$, and an output terminal connected to a relay Rd.

The opposite ends $A_1$ and $B_1$ of the resistive bar 11*a* are connected to a second DC power supply $E_L$, and the end $B_1$ is grounded. As shown in FIG. 5(B), an auxiliary relay Ry is driven through a relay contact $Rr_2$ and the normally open contact $Rd_1$ of a relay Rd. The end Ad of the conductive bar 11*b* is connected through the normally open contact $Ry_1$ of the auxiliary relay Ry to an indication control circuit 30 to give a position signal $V_{31}$ to the indication control circuit 30. In this description, parts similar to or corresponding to those described previously with reference to the following embodiments are denoted by like reference characters.

While the loom is operating normally, the relay contact $Rr_1$ is closed, the relay contact $Rr_2$ is open. Therefore, the output voltage $V_H$ of the first DC power supply $E_H$ is applied to the end Ad of the conductive bar 11*b* and, since no dropper 12 has dropped, an actuating signal $V_{21}=V_H$ is applied to the stop control circuit 20, and hence the amplifier 22 provides no stop signal Ss.

When a warp yarn W is broken and a dropper 12 associated with the broken warp yarn W drops, the conductive bar 11*b* is grounded via the dropper 12 and the resistive bar 11*a*. Consequently, the actuating signal $V_{21}$ becomes smaller than the output voltage $V_H$ of the first DC power supply $E_H$. The amplifier 22 detects the variation of the actuating signal $V_{21}$ and provides a stop signal Ss.

Then, the relay contact $Rr_1$ opens and the relay contact $Rr_2$ closes to disconnect the stop control circuit 20 from the dropper unit 10 while the changeover control circuit 40 is connected to the dropper unit 10. In this state, the residual voltage of charge accumulated in the dropper bar 11 is applied as a signal $V_{41}$ to the comparator 41. Therefore, when the comparator 41 is able to operate the relay Rd upon the detection of $V_{41} \leqq V_0$, the changeover control circuit 40 is able to detect the moment when the charge accumulated in the dropper bar 11 is discharged completely. The output voltage $V_0$ of the reference power supply $E_0$ is a minimum voltage where the influence of the residual charge of the dropper bar 11 can be neglected.

When the relay Rd is operated to operate the auxiliary relay Ry (FIG. 5(B)) through the contact $Rd_1$, the indication control circuit 30 is connected through the contact $Ry_1$ of the auxiliary relay Ry to the dropper unit 10, and then the indication control circuit 30 indicates the position of the dropped dropper 12 on the dropper bar 11. In FIG. 5(A), power can be supplied to the resistive bar 11*a* for the least necessary time from the second DC power supply $E_L$ by connecting the normally open contact $Ry_1$ of the auxiliary relay Ry in series to the second DC power supply $E_L$ to obviate the useless heat generation of the resistive bar 11*a*.

Figure 6:
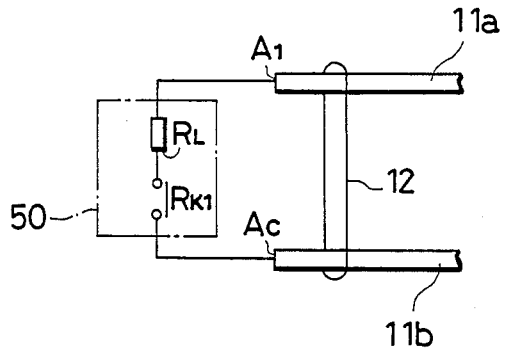
FIG. 6 is a circuit diagram showing the constitution of an essential portion of a warp yarn breakage detecting and indicating apparatus, in a fourth embodiment, according to the present invention.
Figure 7A:
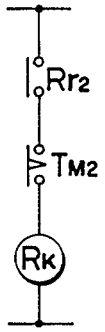
FIGS. 7(A) and 7(B) are circuit diagrams of an auxiliary relay driving circuit.
Figure 7B:
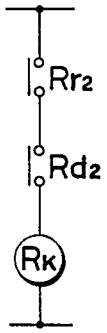

A warp yarn breakage detecting and indicating apparatus, in a fourth embodiment, according to the present invention will be described with reference to FIGS. 6, 7(A) and 7(B). This warp yarn breakage detecting and indicating apparatus is a modification of the foregoing embodiment shown in FIG. 3 or 5(A).

This warp yarn breakage detecting and indicating apparatus has a forced discharge circuit 50 (FIG. 6) provided between the resistive bar 11*a* and the conductive bar 11*b*. The forced discharge circuit 50 comprises a series circuit of a current limiting resistor $R_L$ and the normally open contact $Rk_1$ of an auxiliary relay Rk. The forced discharge circuit 50 enables the dropper bar 11 to discharge the charge thereof surely and rapidly during the operation for changing over the circuit connected to the dropper unit 10 from the stop control circuit 20 to the indication control circuit 30 even if a dropped dropper 12 is in unsatisfactory electrical contact with the dropper bar 11. The auxiliary relay Rk is operated during the set time $t_1$ (FIG. 4) after the dropper 12 has dropped, or the auxiliary relay Rk may be driven through a series circuit of the relay contact $Rr_2$ and the ON-delay normally closed contact $T_{M2}$ of the timer $T_M$ (FIG. 7(A)) or through a series circuit of the relay contact $Rr_2$ and the normally closed contact $Rd_2$ of the relay Rd (FIG. 7(B)) so as to operate before the relay Rd of FIG. 5(A) is operated. And the current limiting resister $R_L$ is able to be left out, since this resister $R_L$ merely work on protecting the contact $Rk_1$.

As apparent from the foregoing description, the warp yarn breakage detecting and indicating apparatus of the present invention is capable of implementing both a warp yarn breakage detecting function and a warp yarn breakage indicating function, which are operating characteristics contrary to each other, without requiring any particular arrangement which will make the constitution of the loom complex.

Furthermore, in changing over the circuit connected to the dropper unit from the stop control circuit to the indication control circuit, the malfunction of the indication control circuit due to the influence of charge accumulated in the dropper bar or the destruction of the component elements of the indication control circuit by the charge accumulated in the dropper bar is obviated by delaying the connection of the indication control circuit to the dropper unit by the agency of a timer or by ensuring the complete discharge of the charge accumulated in the dropper bar by the changeover control circuit.

What is claimed is:

1. A warp yarn breakage detecting and indicating apparatus for a loom provided with a dropper unit comprising a dropper bar having a combination of a conductive bar and a resistive bar insulated from the conductive bar, and a plurality of droppers supported each on a warp yarn of a warp on the loom and capable of dropping on the dropper bar to short-circuit the conductive bar and the resistive bar when the associated warp yarn is broken; said warp yarn breakage detecting and indicating apparatus comprising:

a stop control circuit for stopping the loom, normally connected to the dropper unit only while the loom is in operation, having a first DC power supply, and capable of providing a stop signal to stop the loom upon the detection of the variation of an actuating signal based on the output voltage of the first DC power supply; and an indication control circuit normally disconnected from the dropper unit while the loom is in operation, capable of being connected to the dropper unit only after the stop control circuit has been disconnected from the dropper unit when the loom is stopped, having a second DC power supply, and capable of indicating a position signal corresponding to a division of the output voltage of the second DC power supply, corresponding to the position of the dropped dropper on the resistive bar of the dropper unit.

2. A warp yarn breakage detecting and indicating apparatus according to claim 1, wherein said resistive bar is connected to said second DC power supply only while the loom is stopped.

3. A warp yarn breakage detecting and indicating apparatus according to claim 1, wherein a relay circuit controlled for breaking and making circuits by the stop signal is associated with said stop control circuit and said indication control circuit to connect said stop control circuit and said indication control circuit alternately to said dropper unit.

4. A warp yarn breakage detecting and indicating apparatus according to claim 3, wherein said relay circuit is provided with a timer to connect said indication control circuit to said dropper unit after a predetermined time from the stop of the loom.

5. A warp yarn breakage detecting and indicating apparatus according to claim 3, wherein said relay circuit comprises a changeover control circuit including a comparator to connect said indication control circuit to said dropper unit after a predetermined time from the stop of the loom and to confirm the complete discharge of the charge accumulated in the dropper bar.

6. A warp yarn breakage detecting and indicating apparatus according to claim 1, wherein a forced discharge circuit is connected to said dropper unit to discharge charge accumulated in said dropper bar, when the stop signal is associated.

7. A warp yarn breakage detecting and indicating apparatus according to claim 6, wherein said forced discharge circuit has a current limiting resistance.

* * * * *